US011547211B2

(12) United States Patent
Hoffmann et al.

(10) Patent No.: US 11,547,211 B2
(45) Date of Patent: Jan. 10, 2023

(54) ARRANGEMENT FOR GUIDING AT LEAST ONE MOVABLE FURNITURE PART

(71) Applicant: Julius Blum GmbH, Hoechst (AT)

(72) Inventors: Benjamin Hoffmann, Dornbirn (AT); Marc Meusburger, Egg (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/242,956

(22) Filed: Apr. 28, 2021

(65) Prior Publication Data

US 2021/0244183 A1 Aug. 12, 2021

Related U.S. Application Data

(63) Continuation of application No. PCT/AT2019/060371, filed on Nov. 5, 2019.

(30) Foreign Application Priority Data

Nov. 13, 2018 (AT) ..... A 50981/2018

(51) Int. Cl.
*A47B 88/487* (2017.01)
*A47B 88/477* (2017.01)
*E05D 15/56* (2006.01)

(52) U.S. Cl.
CPC ..... *A47B 88/487* (2017.01); *A47B 88/477* (2017.01); *E05D 15/565* (2013.01);
(Continued)

(58) Field of Classification Search
CPC . A47B 88/0466; A47B 88/437; A47B 88/473; A47B 88/477; A47B 88/487;
(Continued)

(56) References Cited

U.S. PATENT DOCUMENTS 4,692,035 A 9/1987 Röck et al.
5,131,449 A 7/1992 Winn et al.
(Continued)

FOREIGN PATENT DOCUMENTS

AT 519752 A4 * 10/2018 ..... A47B 88/493
CH 696416 A5 * 6/2007 ..... A47B 88/40
(Continued)

OTHER PUBLICATIONS

International Search Report dated Jan. 3, 2020 in International (PCT) Application No. PCT/AT2019/060371.

*Primary Examiner* — Andrew M Roersma
(74) *Attorney, Agent, or Firm* — Wenderoth, Lind & Ponack, L.L.P.

(57) ABSTRACT

An arrangement for guiding at least one movable furniture part includes a guide rail to be mounted on the fixed furniture part, a guide device to be coupled to the movable furniture part, and a preferably substantially cylindrical, load-transmitting rolling body. The guide rail has a guide track, on which the load-transmitting rolling body is mounted in a movable manner. The guide track has a parking position for the load-transmitting rolling body, and the parking position corresponds to an end position of the movable furniture part relative to the fixed furniture part. The load-transmitting rolling body and the guide track are designed such that the guide track can be deformed in this region, a depression being formed in the process, and the load-transmitting rolling body is substantially dimensionally stable.

19 Claims, 6 Drawing Sheets

(52) U.S. Cl.
CPC ..... *A47B 2210/0029* (2013.01); *A47B 2210/0043* (2013.01)

(58) Field of Classification Search
CPC ..... A47B 88/14; A47B 2210/0002; A47B 2210/0029; A47B 2210/0032; A47B 2210/0037; A47B 2210/0043; E05D 15/565
See application file for complete search history.

(56) References Cited

U.S. PATENT DOCUMENTS

| | | | | |
|---|---|---|---|---|
| 5,417,496 | A * | 5/1995 | Hobbs | F16C 29/04 384/18 |
| 5,580,174 | A * | 12/1996 | Houck | A47B 88/487 384/19 |
| 8,235,479 | B2 * | 8/2012 | Yu | A47B 88/49 312/334.8 |
| 9,068,386 | B2 | 6/2015 | Ishii et al. | |
| 10,316,565 | B2 | 6/2019 | Gabi | |
| 2015/0008811 | A1 | 1/2015 | Ishii et al. | |
| 2016/0076293 | A1 | 3/2016 | Halfon et al. | |
| 2017/0247924 | A1 | 8/2017 | Gabl | |
| 2017/0260789 | A1 * | 9/2017 | Gabl | E06B 3/509 |
| 2019/0284859 | A1 | 9/2019 | Rupp et al. | |
| 2019/0330898 | A1 | 10/2019 | Rupp et al. | |

FOREIGN PATENT DOCUMENTS

| | | | | |
|---|---|---|---|---|
| CN | 105308250 | | 2/2016 | |
| CN | 107002438 | | 8/2017 | |
| DE | 3332517 | A1 * | 3/1985 | A47B 88/467 |
| DE | 40 28 878 | | 3/1991 | |
| DE | 10 2010 016 002 | | 9/2011 | |
| EP | 2992782 | A1 * | 3/2016 | A47B 88/493 |
| GB | 503472 | | 10/1938 | |
| JP | 6-212854 | | 8/1994 | |
| JP | 9-103331 | | 4/1997 | |
| JP | 2004-137789 | | 5/2004 | |
| TW | 201829899 | | 8/2018 | |
| TW | 201831770 | | 9/2018 | |
| WO | 2013/114730 | | 8/2013 | |
| WO | 2017/102617 | | 6/2017 | |
| WO | 2018/129568 | | 7/2018 | |

* cited by examiner

ARRANGEMENT FOR GUIDING AT LEAST ONE MOVABLE FURNITURE PART

BACKGROUND OF THE INVENTION

The invention concerns an arrangement for guiding at least one moveable furniture part, in particular at least one furniture door or at least one drawer, relative to a stationary furniture part. The arrangement includes at least one guide rail to be mounted in particular to the stationary furniture part, and at least one guide device which can be coupled to the at least one moveable furniture part and which has at least one preferably substantially cylindrical load-transmitting rolling body. The at least one guide rail has at least one track on which the at least one load-transmitting rolling body is moveably mounted, the at least one track has at least one parking position for the at least one load-transmitting rolling body and the at least one parking position corresponds to an end position of the at least one moveable furniture part relative to the stationary furniture part. The invention further concerns an article of furniture comprising at least one moveable furniture part, in particular at least one furniture door or a drawer, a stationary furniture part and at least one such arrangement for guiding the at least one moveable furniture part relative to the stationary furniture part.

FIG. 1 shows a combination of a rolling body 106 mounted rotatably about an axis of rotation 133 and a track 107, as is used in the state of the art. In this arrangement, in a parking position 108 of the rolling body 106, flattening can occur in the contact region of the rolling body 106 with the track 107 due to the loading of the rolling body 106. If now the rolling body 106 is moved out of the parking position 108 by rotation about the axis of rotation 133, the flattening 134 firstly moves away from the track 107, in the course of a continued rotary movement it moves to the track 107 again and then comes into contact with same again. The change between the round region of the rolling body 106 and the flattened region 134 on the track 107 gives rise to a rattling noise which is perceived as being troublesome for a user.

To overcome that problem, there are approaches which involve providing the rolling body 106 with a plastic sheath to avoid flattening of the rolling body 106. It is found, however, that the described problem is not overcome thereby but only delayed as the plastic sheath splits sooner or later.

SUMMARY OF THE INVENTION

The object of the present invention is to provide an arrangement which is improved over the state of the art for guiding at least one moveable furniture part relative to a stationary furniture part, in which the described disadvantage is avoided, and an article of furniture having such an improved arrangement.

With the arrangement according to the invention, the at least one load-transmitting rolling body and the at least one track have such a configuration at least in the region of the at least one parking position that the at least one track is deformable in that region, forming a depression, and the at least one load-transmitting rolling body is substantially stable in shape.

Therefore the attempt is not made, as in the state of the art, to prevent flattening of the rolling body. Rather, flattening in the region of the parking position is intentionally accepted, although not on the rolling body but on the at least one track. Therefore a depression can be formed in the at least one track in the region of the at least one parking position. That however does not lead to troublesome generation of noise as the depression is arranged in an end position of the at least one moveable furniture part. The at least one load-transmitting rolling body is therefore only moved into and out of the depression, but generally does not have to pass the depression. An exception is represented by a configuration in which the at least one guide device includes more than one load-transmitting rolling body. In that case a plurality of depressions can be formed in the track in the region of the parking position. In the case of a movement of the moveable furniture part out of the end position that can then result in it travelling over depressions, but only in the region of the parking position and not over the entire range of movement along the track, as in the state of the art.

In a preferred embodiment of the invention, the at least one load-transmitting rolling body has a greater hardness in comparison with the at least one track at least in the region of the at least one parking position. That can ensure that the at least one track is deformable in that region to form a depression and the at least one load-transmitting rolling body is substantially stable in shape.

For reasons of stability, advantageously the at least one guide rail has a support structure, preferably of steel, and at least one contact portion, preferably of plastic, particularly preferably of polyoxymethylene, for providing at least a part of the at least one track.

In that connection, it is appropriate for the at least one contact portion to be replaceable and/or to be of a thickness of 1 to 8 mm, preferably 3 mm.

In advantageous embodiments, there can be at least one securing element with which the at least one contact portion can be fixed to the at least one guide rail. Preferably, the at least one securing element is substantially U-shaped and/or has at least one spring element and/or at least one friction element for increasing the friction at a contact contour, in particular in the form of a groove, of the at least one guide rail, and/or the at least one securing element has at least one actuating element by way of which the at least one securing element and the at least one contact portion connected thereto are moveable, and/or there is provided at least one latching device, by way of which the at least one securing element can be releasably fixed to the at least one contact portion, wherein the at least one latching device has at least one latching recess and at least one latching projection.

Contact portions on guide rails for guiding, for example, hanging doors are already known. However, they serve for noise damping purposes or to minimize the wear of the guide rails. Such contact portions are to be distinguished from the contact portions which are used according to the invention and which are used in combination with especially designed rolling bodies and which, in particular, allow the formation of an even long-lasting depression in the region of the parking position of the at least one track.

Therefore, the at least one track is substantially irreversibly deformable, to form the depression, at the at least one parking position of the at least one load-transmitting rolling body.

The at least one load-transmitting rolling body, with the application of a force, is moveable out of the depression formed in the region of the at least one parking position in the at least one track. That, however, does not necessarily have to be perceived as a disadvantage by a user. On the contrary, the fact that the user feels when the at least one rolling body moves into or out of the depression can even be perceived as a positive as in that way the user registers that he has reached an end position, associated with at least one parking position, of the moveable furniture part in relation to the stationary furniture part.

Preferably, the at least one load-transmitting rolling body is formed at least region-wise and preferably completely from steel.

In addition, the at least one track has at least two different material portions, wherein a first material portion is arranged in the region of the at least one parking position and a second material portion is arranged in a dynamic region adjoining the region of the at least one parking position. In that way, the running properties of the moveable furniture part can be coordinated in a specifically targeted fashion.

Alternatively or in addition, the at least one track has at least region-wise a concave configuration in cross-section and/or the at least one load-transmitting rolling body has a peripheral surface which is at least region-wise of a convex configuration in cross-section. Such a configuration has the advantage that at the same time it provides support in the lateral direction.

It has proven desirable if the arrangement includes at least one carrier on which the at least one moveable furniture part can be preferably pivotably mounted and which can be coupled to the at least one guide device, and/or the arrangement has at least one transverse rail which is or can be arranged transversely to the at least one guide rail and at least one carriage which can be coupled to the at least one moveable furniture part and which can be mounted displaceably on the at least one transverse rail.

As stated in the opening part of this specification, protection is also claimed for an article of furniture comprising at least one moveable furniture part, in particular at least one furniture door or a drawer, a stationary furniture part and at least one arrangement according to the invention for guiding the at least one moveable furniture part relative to the stationary furniture part.

According to a preferred embodiment, the at least one moveable furniture part is in the form of a furniture door, in particular a folding-sliding door, and the article of furniture has at least one internal space and at least one side compartment in particular having a shaft shape. The at least one arrangement is designed and is so arranged on the article of furniture to guide the at least one furniture door relative to the stationary furniture part between a closed position outwardly covering the at least one internal space and an open position being at least region-wise sunk in the at least one side compartment and in which the at least one internal space is freely accessible to a user.

In that connection, it has proven to be advantageous if the arrangement for guiding the at least one furniture door extends at least portion-wise in a depth direction of the at least one side compartment and the at least one parking position of the at least one load-transmitting rolling body corresponds to an end position of the at least one furniture door of being substantially completely arranged in the at least one side compartment. Preferably, the at least one track has a further parking position for the at least one load-transmitting rolling body which corresponds to a position of the at least one furniture door in which the at least one furniture door is arranged substantially parallel to and substantially completely outside the at least one side compartment of the stationary furniture part.

And finally, it has been found advantageous if the stationary furniture part has at least one side surface which at least region-wise delimits the at least one side compartment and at which the at least one guide rail of the arrangement for guiding the at least one furniture door is at least portion-wise arranged.

BRIEF DESCRIPTION OF THE DRAWINGS

Further details and advantages of the invention will be described more fully hereinafter in the specific description with reference to the drawings in which.

DETAILED DESCRIPTION OF THE INVENTION

Figure 1:
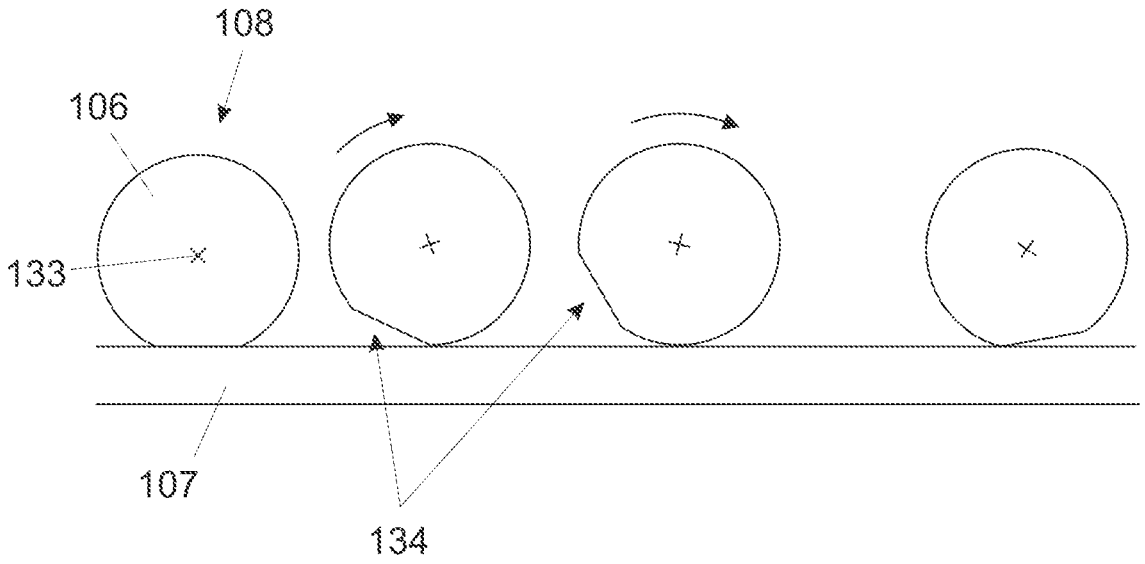
FIG. 1 shows a combination of a rolling body and a track according to the state of the art.

FIG. 1 shows the state of the art and has already been described in the introductory part of the present description.

Figure 2A:
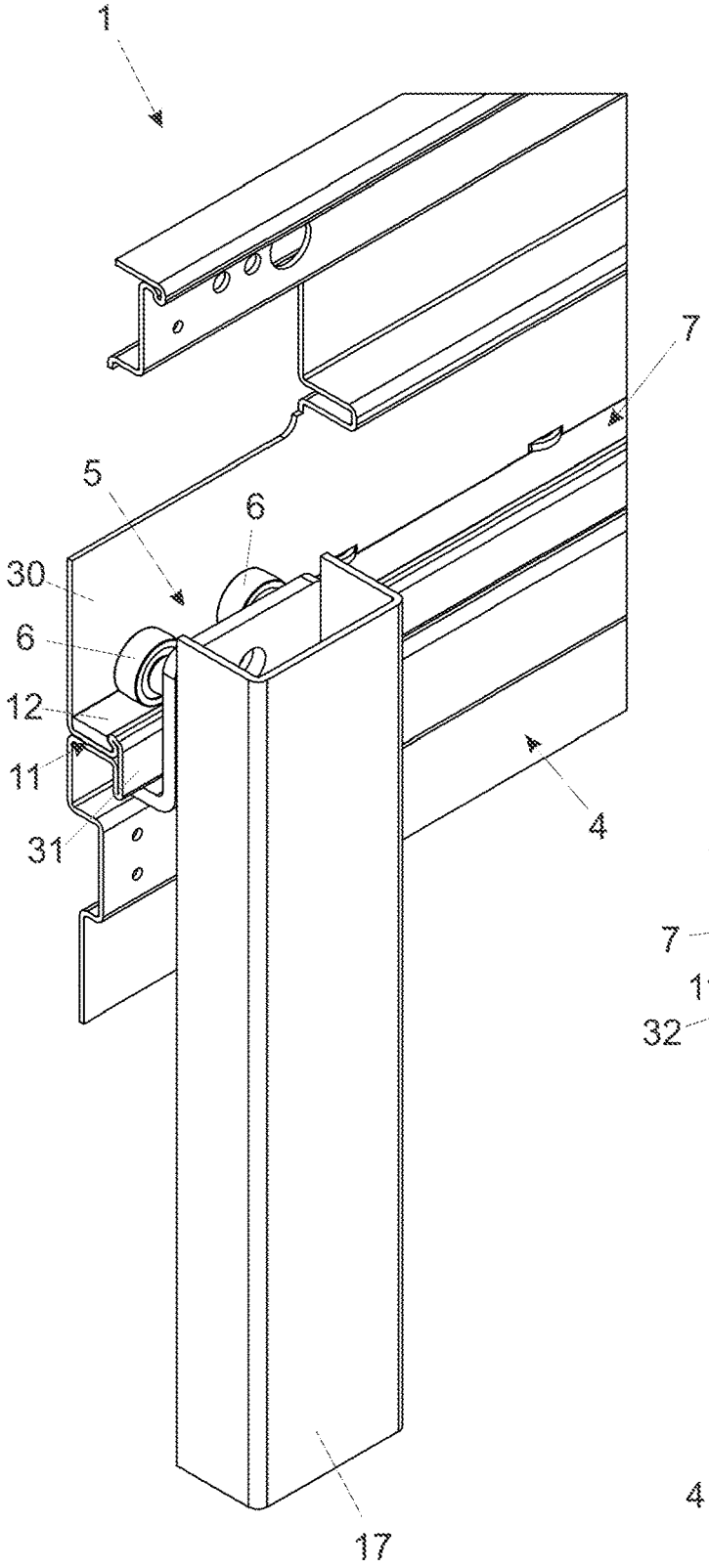
FIGS. 2*a*, 2*b* show a preferred embodiment of an arrangement according to the invention in a diagrammatically illustrated perspective view (FIG. 2*a*) and a diagrammatically illustrated side view (FIG. 2*b*)
Figure 2B:
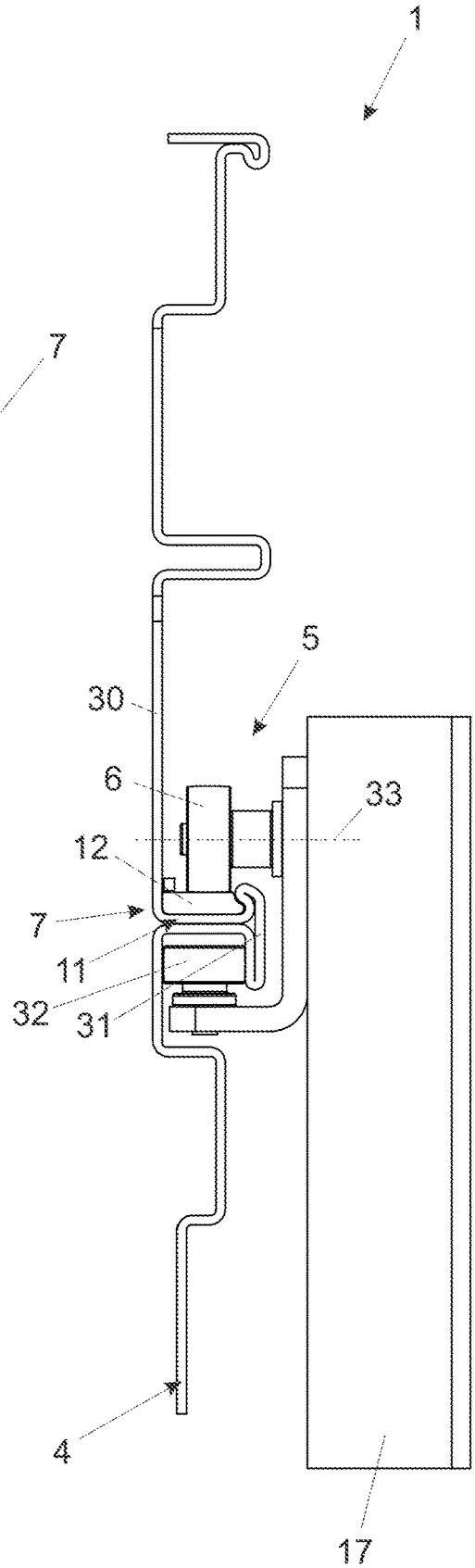

FIGS. 2*a*, 2*b* show a preferred embodiment of an arrangement 1 for guiding at least one moveable furniture part, in particular at least one furniture door or at least one drawer, relative to a stationary furniture part, including a guide rail 4 which is to be mounted in particular to the stationary furniture part and at least one guide device 5 which can be coupled in particular to the at least one moveable furniture part and which has a substantially cylindrical load-transmitting rolling body 6. The guide rail 4 has a track 7 on which the load-transmitting rolling body 6 is moveably mounted, and the track 7 has at least one parking position 8, 9 (see FIGS. 3*a*, 3*b*) for the load-transmitting rolling body 6 and the at least one parking position 8, 9 corresponds to an end position of the at least one moveable furniture part relative to the stationary furniture part. In this arrangement, the load-transmitting rolling body 6 and the track 7 have such a configuration at least in the region of the at least one parking position 8, 9 that the track 7 in that region is deformable to form a depression 10 and the load-transmitting rolling body 6 is substantially stable in shape.

In the specifically illustrated case the guide device 5 includes two load-transmitting rolling bodies 6. In addition there is provided a guide roller 32 for lateral guidance.

The load-transmitting rolling bodies 6 have a greater hardness in comparison with the track 7, at least in the region of the at least one parking position 8, 9. Conversely, that means that the track 7 is softer at least in the region of the at least one parking position 8, 9, than the load-transmitting rolling bodies 6.

The hardness of the load-transmitting rolling bodies 6 and the track 7 can be influenced by various factors. They include the choice of the materials used and the shape.

In the illustrated embodiment the guide rail 4 has a support structure 11 of steel and a contact portion 12 of plastic, preferably polyoxymethylene, for forming the track 7.

Figure 3A:
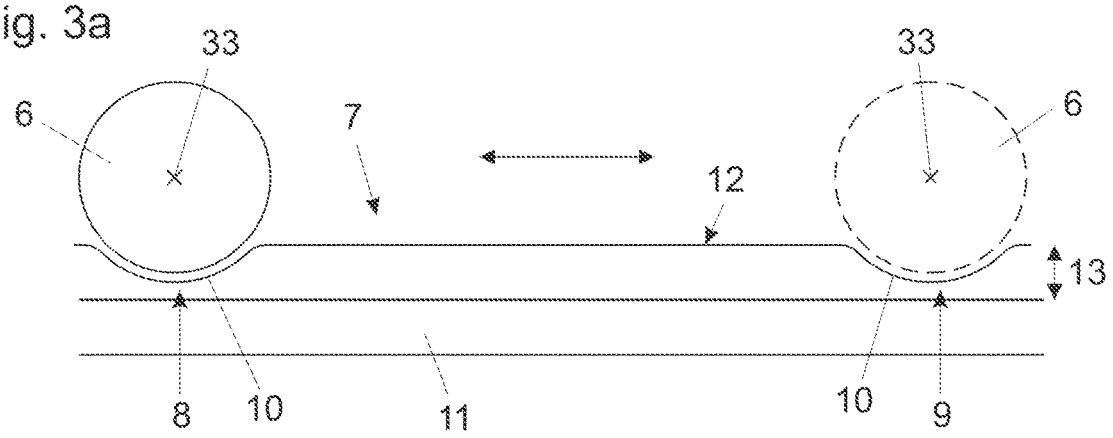
FIGS. 3*a*, 3*b* show two preferred embodiments of a combination of a rolling body on a track each in diagrammatically illustrated side views.
Figure 3B:
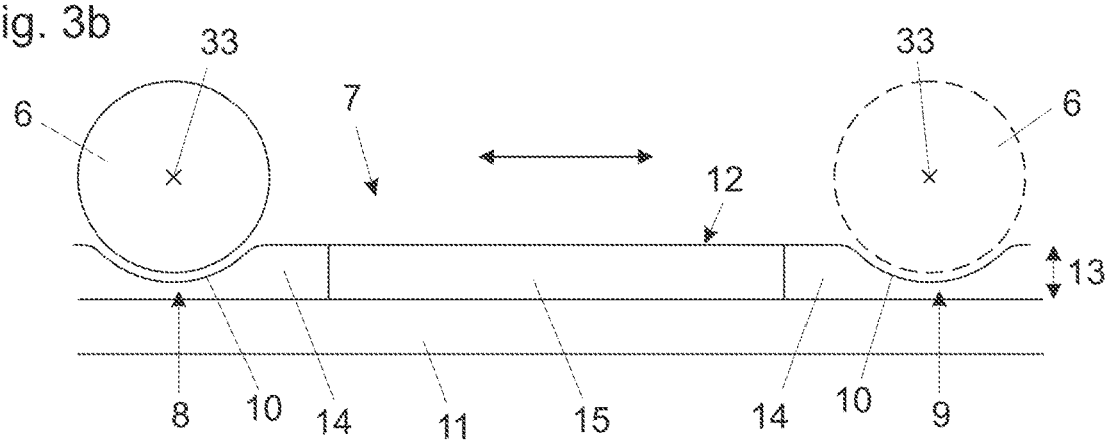

The contact portion 12 is replaceable and has a thickness 13 of 1 mm to 8 mm, preferably 3 mm (see also FIGS. 3*a*, 3*b*).

The load-transmitting rolling bodies 6 are formed from steel.

The guide rail 4 has two vertical legs 30 and 31, wherein the vertical legs 30 and 31 jointly with the support structure 11 define a groove for receiving the contact portion 12. At the same time, the guide roller 32 also bears against the vertical leg 31.

The load-transmitting rolling bodies 6 are mounted rotatably about an axis of rotation 33 which in the position of use is oriented substantially horizontally.

In the illustrated case, the arrangement 1 includes a carrier 17 to which the at least one moveable furniture part can be preferably pivotably mounted and which is coupled to the guide device 5.

FIGS. 3*a*, 3*b* show two preferred embodiments of the combination of a load-transmitting rolling body 6 and a track 7.

In both cases the track 7 has two respective mutually spaced parking positions 8 and 9 which respectively correspond to an end position of the moveable furniture part relative to the stationary furniture part and between which the load-transmitting rolling body 6 is moveably mounted, wherein the rolling body 6 performs a rotation about its axis of rotation 33 in a movement along the track 7.

The drawing diagrammatically shows that the load-transmitting rolling body 6 and the track 7, at least in the region of the parking positions 8, 9, have a configuration such that the track 7 is deformable in those regions by the rolling bodies 6 to form a depression 10, and the load-transmitting rolling body 6 is substantially stable in shape. In comparison with the state of the art shown in FIG. 1, therefore, the rolling body 6 does not suffer from flattening. Rather, the formation of a trough on the track 7 in the region of the parking positions 8, 9 is accepted.

That can involve substantially irreversible deformation of the track 7.

The load-transmitting rolling body 6 is moveable with the application of a force out of the depressions 10 formed in the track 7 in the region of the parking positions 8, 9.

In the embodiment shown in FIG. 3*b*, the track 7 has two different material portions 14, 15, wherein a first material portion 14 is arranged in the region of the parking positions 8, 9 and a second material portion 15 is arranged in a dynamic region adjoining the regions of the parking positions 8, 9.

Figure 4:
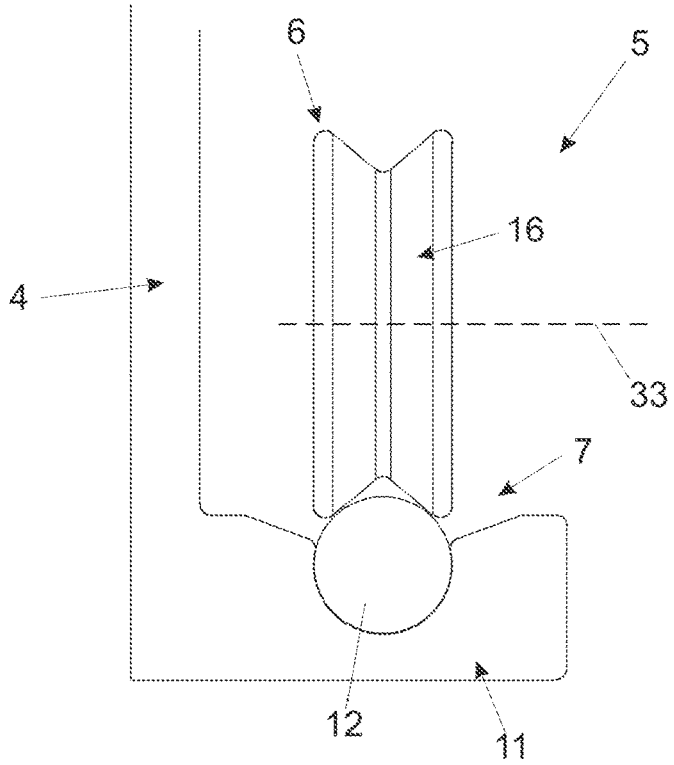
FIG. 4 shows a further preferred embodiment of a combination of a rolling body and a track in a diagrammatically illustrated cross-sectional view.

In the preferred embodiment shown in FIG. 4 the track 7 at least region-wise has a concave configuration in cross-section. At the same time, the load-transmitting rolling body 6 has a peripheral surface 16 which has a region-wise convex configuration in cross-section. With that design configuration, the need for a lateral guide roller 32, as shown in FIGS. 2*a*, 2*b* can disappear.

FIGS. 5*a* to 5*d* show a preferred embodiment of an article of furniture 20 in which the arrangement 1 according to the invention can preferably be used. Specifically, the article of furniture 20 has two moveable furniture parts 2 in the form of folding-sliding doors, a stationary furniture part 3, and an arrangement 1 for guiding the moveable furniture parts 2 relative to the stationary furniture part 3.

The article of furniture 20 has an internal space 21 and two side compartments 22 in the form of shafts. The arrangement 1 is designed and arranged on the article of furniture 20 so as to guide the furniture doors 2 relative to the stationary furniture part 3 between a closed position outwardly covering the internal space 21 (see FIG. 5*a*), and an open position of being at least region-wise sunk in a respective side compartment 22 (see FIG. 5*d*) in which the internal space 21 is freely accessible to a user. Therebetween, the furniture doors 2 can assume intermediate positions shown in FIGS. 5*b* and 5*c*.

Figure 5A:
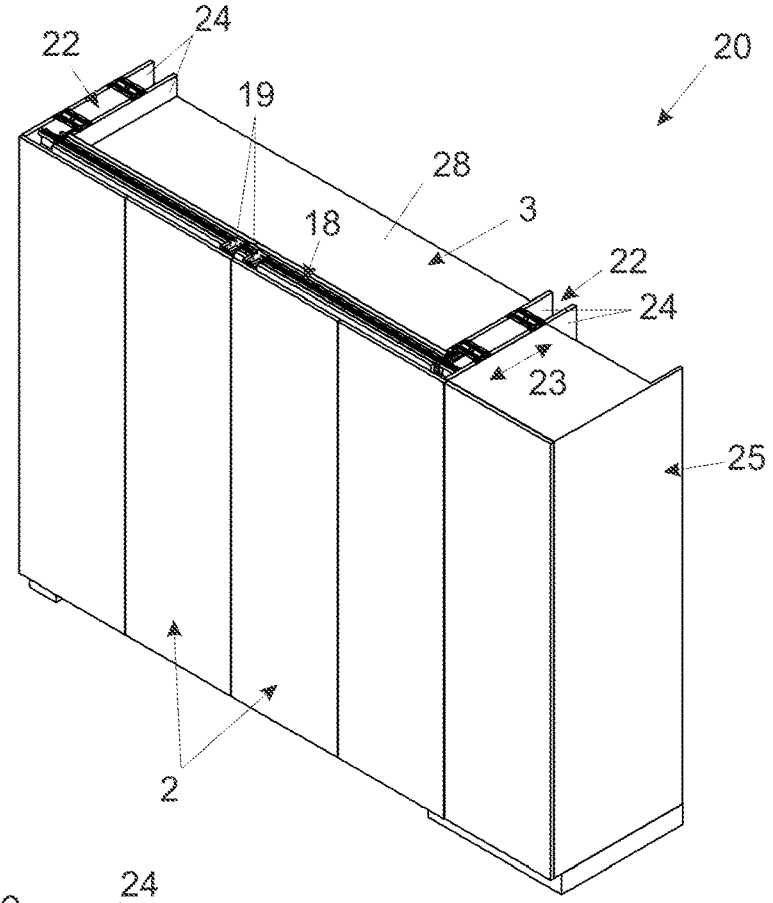
FIGS. 5*a*-5*d* show a preferred embodiment of an article of furniture with two folding-sliding doors each in a diagrammatically illustrated perspective view, wherein the folding-sliding doors in FIG. 5*a* are arranged in a closed position, in FIG. 5*b* one of the folding-sliding doors is arranged in a folded-open position, the folding-sliding doors in FIG. 5*c* are arranged in an open position outside the side compartments of the article of furniture and the folding-sliding doors in FIG. 5*d* are arranged in an open position within the side compartments of the article of furniture.
Figure 5B:
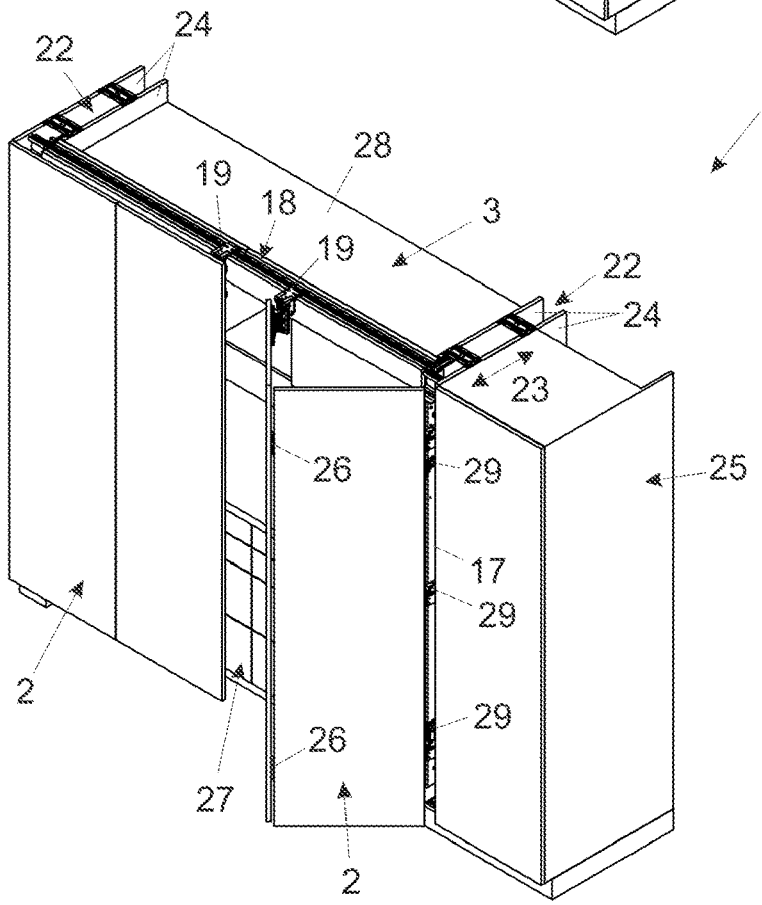
Figure 5C:
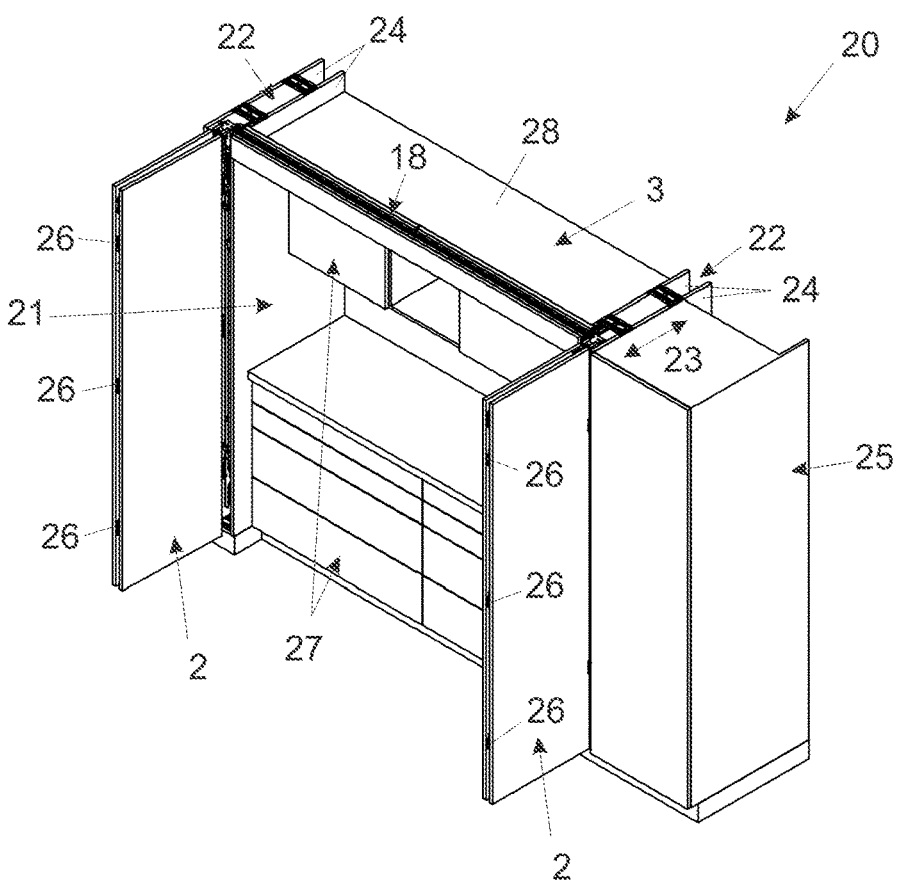
Figure 5D:
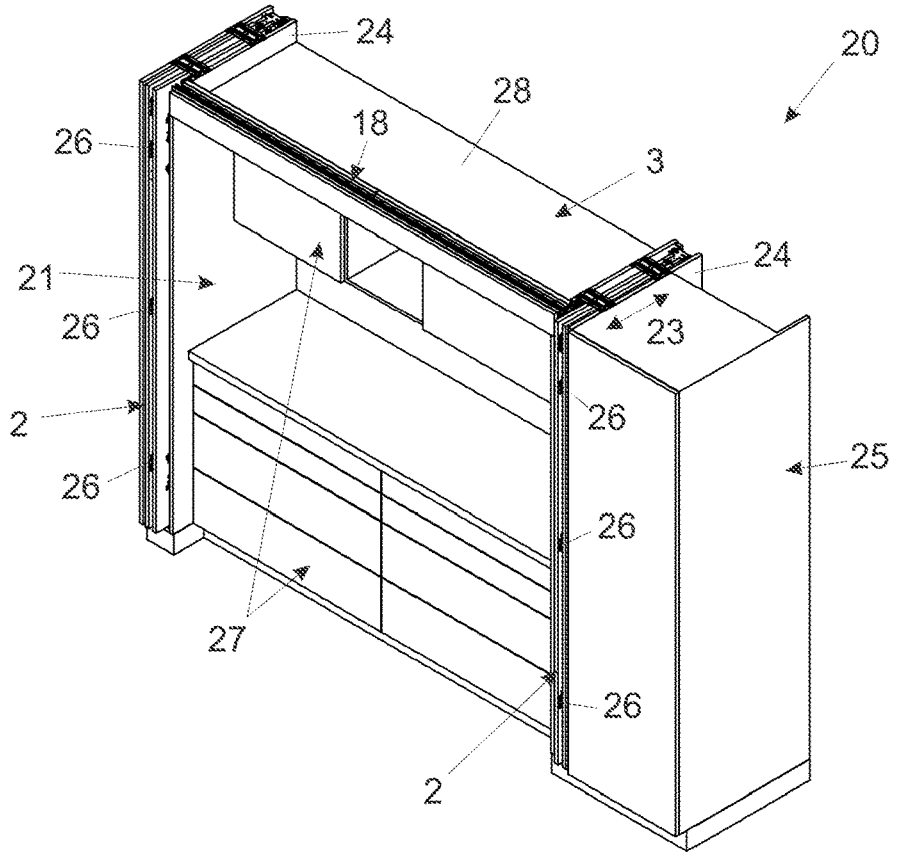

The end positions of the moveable furniture doors 2 corresponding to the two parking positions 8 and 9 in FIGS. 3*a*, 3*b* are shown in FIGS. 5*c* and 5*d*. A first parking position 8 of the at least one load-transmitting rolling body 6 corresponds to a respective end position of the respective furniture door 2 in which it is substantially completely arranged in the side compartment 22 (see FIG. 5*d*), and a further parking position 9 for the at least one load-transmitting rolling body 6 corresponds to a position of the respective furniture door 2 in which the furniture door 2 is arranged substantially parallel to and substantially completely outside the associated side compartment 22 of the stationary furniture part 2 (see FIG. 2*c*).

Instead of two furniture doors 2 it is also possible to provide only one or more than two furniture doors 2. In addition, the furniture doors 2 may comprise only one door leaf and not, as in the illustrated case, two door leaves which are hingedly connected together by way of door hinges 26.

The arrangement 1 for guiding the furniture doors 2 respectively extends portion-wise in a depth direction 23 of the two side compartments 22.

In specific terms, the stationary furniture part 3 can have a plurality of side surfaces 24 which region-wise delimit the side compartments 22. At least one respective guide rail 4 of the arrangement 1 for guiding the furniture doors 2 is at least portion-wise arranged on a respective one of the side surfaces 24.

Besides the guide rails 4, the arrangement 1 includes a transverse rail 18 arranged substantially perpendicularly to the guide rails 4 and for each furniture door 2, a respective carriage 19 which is coupled to the furniture door 2 and which can be displaceably mounted on the guide rail 18. The carriages 19 can be entrained by the carrier 17 in a movement between the end positions shown in FIGS. 5*c* and 5*d*. The transverse rail 18 can be arranged on a top surface 28 of the stationary furniture part 3.

Each of the furniture doors 2 is also hingedly connected to a carrier 17 by way of carrier hinges 29.

The article of furniture 20 can also have still further furniture parts like for example a cupboard 25.

Preferably, kitchen furniture 27 like for example bottom cabinets with drawers and/or top cabinets are preferably arranged in the internal space 21 of the stationary furniture part 3, as in the illustrated case. The moveable furniture parts 2 therefore serve to cover a kitchen formed therefrom when not in use.

Figure 6:
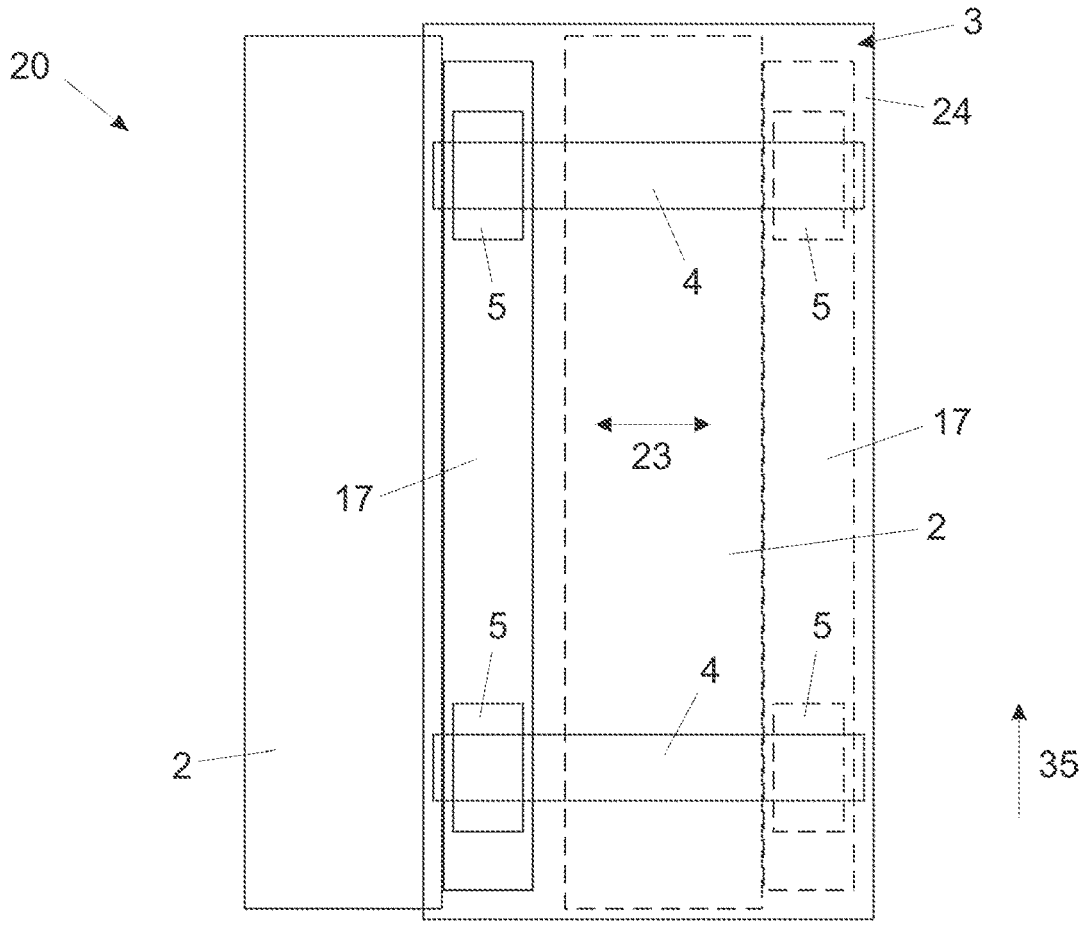
FIG. 6 shows a further preferred embodiment of an article of furniture with a furniture door in a diagrammatically illustrated side view, wherein the furniture door is arranged in an open position outside (solid lines) and within (broken lines) a side compartment of the article of furniture.

FIG. 6 shows a further preferred embodiment of an article of furniture 20. The article of furniture 20 includes a stationary furniture part 3 with a side surface 24 which region-wise delimits a side compartment of the article of furniture 20. A moveable furniture door 2 is mounted to the side surface 24 moveably between the two end positions shown in the Figure, more specifically indirectly by way of a carrier 17 which is displaceable on two guide rails 4 by way of two guide devices 5 spaced from each other in the vertical direction 35. At least one of the two guide rails 4 has a track 7 on which at least one load-transmitting rolling body 6 of one of the guide devices 5 is moveably mounted. The load-transmitting rolling body 6 and the track 7 have such a configuration, at least in the region of the parking positions 8, 9 corresponding to the end positions of the furniture door 3, that the track 7 is deformable in that region to form a depression 10, and the load-transmitting rolling body 6 is substantially stable in shape.

Figure 7A:
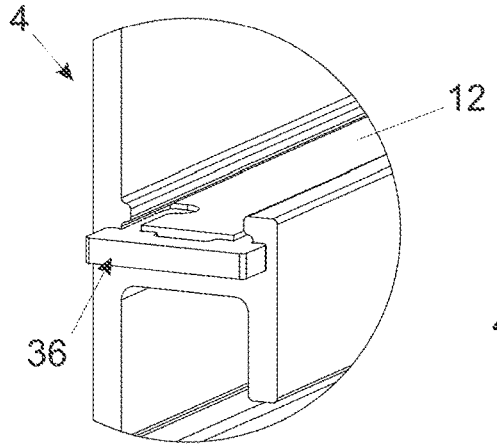
FIGS. 7*a*, 7*b* show two relevant portions of a further preferred embodiment in which there is provided a contact portion which is fixed to the guide rail by way of a securing element, in the installed state (FIG. 7*a*) and in an exploded view (FIG. 7*b*).
Figure 7B:
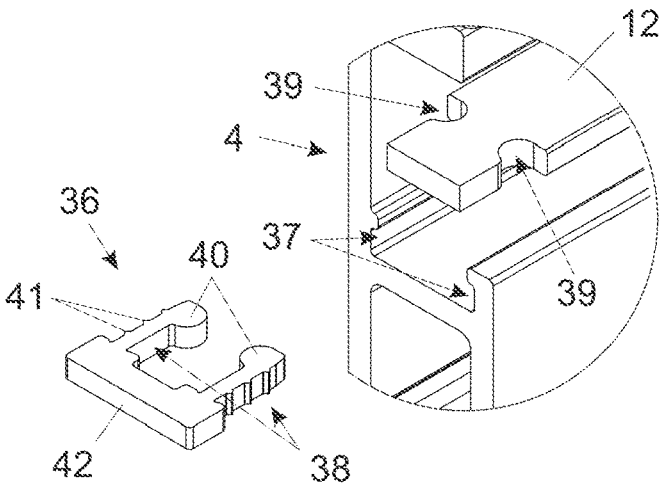

FIGS. 7*a* and 7*b* show a further preferred embodiment including a contact portion 12 fixed to the guide rail 4 by a securing element 36.

The securing element 36 can be of a substantially U-shaped configuration as in the illustrated case.

Furthermore, the arrangement can have a spring element 38. In the illustrated case, there are two spring elements 38 which are oriented substantially parallel to each other and form the two vertical legs of the U-shape.

The securing element 36 can have at least one friction element 41 for increasing the friction against a contact contour of the guide rail 4, in particular in the form of a groove 37. In this case, it is appropriate for a plurality of friction elements 41 to be provided, which for example have a triangular cross-section and which are arranged at an outward side of the spring elements 38.

It is desirable if the securing element 36 as in the illustrated case has an actuating element 42, by way of which the securing element 36 and the contact portion 12 connected thereto are moveable. The actuating element 42 can, for example, form the base of the U-shape, and in the installed state can project at the end out of the guide rail 4. The contact portion 12 can be particularly easily replaced in that way.

And finally it is desirable to provide at least one latching device, by way of which the securing element 36 can be releasably fixed to the contact portion 12. the at least one latching device has at least one latching recess 39 and at least one latching projection 40. In the specifically illustrated case, a respective latching projection 40 is arranged at a free end of the spring elements 38 and can latchingly engage into a corresponding latching recess 39 on the contact portion 12.

The invention claimed is:

1. An arrangement comprising:

a stationary furniture part, a movable furniture part movable relative to the stationary furniture part, a guide rail to be mounted to the stationary furniture part, and a guide device to be coupled to the moveable furniture part, the guide device having a load-transmitting rolling body, wherein the guide rail has a track on which the load-transmitting rolling body is moveably mounted, the track having a parking position for the load-transmitting rolling body, and the parking position corresponds to an end position of the moveable furniture part relative to the stationary furniture part, wherein the track of the guide rail has a plastic contact portion and a support structure supporting the plastic contact portion and non-integrated with the plastic contact portion, wherein the load-transmitting rolling body and the track at least in a region of the parking position are configured such that the plastic contact portion of the track is deformable to form a depression and the load-transmitting rolling body is substantially stable in shape, wherein a hardness of the load-transmitting rolling body is greater than a hardness of the plastic contact portion of the track at least in the region of the parking position.

2. The arrangement as set forth in claim 1, wherein the contact portion is replaceable and/or has a thickness of 1 mm to 8 mm.

3. The arrangement as set forth in claim 1, further comprising a securing element configured to fix the contact portion to the guide rail.

4. The arrangement as set forth in claim 3, wherein the securing element is configured to at least one of:

(i) be substantially U-shaped and/or have a spring element and/or a friction element for increasing the friction at a contact contour formed as a groove of the guide rail, (ii) have an actuating element by which the securing element and the contact portion connected thereto are moveable, and (iii) be releasably fixed to the contact portion by a latching device having a latching recess and a latching projection.

5. The arrangement as set forth in claim 1, wherein the load-transmitting rolling body has at least a portion formed from steel.

6. The arrangement as set forth in claim 1, wherein the track is substantially irreversibly deformable thereby forming the depression at the parking position of the load-transmitting rolling body, and/or wherein the load-transmitting rolling body is moveable with the application of a force out of the depression formed in the region of the parking position in the track.

7. The arrangement as set forth in claim 1, wherein the track has at least two different material portions, wherein a first material portion is arranged in the region of the parking position and a second material portion is arranged in a dynamic region adjoining the region of the parking position.

8. The arrangement as set forth in claim 1, wherein at least a portion of the track has a concave configuration in cross-section, and/or wherein the load-transmitting rolling body has a peripheral surface having at least a portion with a convex configuration in cross-section.

9. The arrangement as set forth in claim 1, further comprising a carrier on which the moveable furniture part is to be pivotably mounted, and to be coupled to the guide device.

10. The arrangement as set forth in claim 1, further comprising a transverse rail to be arranged transversely to the guide rail and a carriage to be coupled to the moveable furniture part and to be mounted displaceably on the transverse rail.

11. The arrangement as set forth in claim 1, wherein the moveable furniture part is a furniture door, and the stationary furniture part has an internal space and a side compartment having a shaft shape, wherein the guide rail and the guide device are configured and arranged to guide the furniture door relative to the stationary furniture part between a closed position outwardly covering the internal space and an open position at least partially sunk in the side compartment and in which the internal space is freely accessible to a user.

12. The arrangement as set forth in claim 11, wherein the guide rail extends at least partially in a depth direction of the side compartment, and the parking position of the load-transmitting rolling body corresponds to an end position of the furniture door of being substantially completely arranged in the side compartment.

13. The arrangement as set forth in claim 12, wherein the stationary furniture part has a side surface which at least partially delimits the side compartment and at which the guide rail is at least partially arranged.

14. The arrangement as set forth in claim 12, wherein the parking position is a first parking position, the track having a second parking position for a second load-transmitting rolling body to be parked at a position of the furniture door, wherein the furniture door is arranged substantially parallel to and substantially completely outside the side compartment of the stationary furniture part.

15. The arrangement as set forth in claim 1, wherein the load-transmitting rolling body is cylindrical.

16. The arrangement as set forth in claim 1, wherein the support structure is a steel support structure, and the plastic contact portion is formed of polyoxymethylene.

17. An arrangement comprising:

a stationary furniture part, a movable furniture part movable relative to the stationary furniture part, a guide rail to be mounted to the stationary furniture part, and a guide device to be coupled to the moveable furniture part, the guide device having a load-transmitting rolling body, wherein the guide rail has a track on which the load-transmitting rolling body is moveably mounted, the track having a parking position for the load-transmitting rolling body, and the parking position corresponds to an end position of the moveable furniture part relative to the stationary furniture part, wherein the track of the guide rail has a plastic contact portion and a support structure supporting the plastic contact portion and non-integrated with the plastic contact portion, wherein the load-transmitting rolling body and the track at least in a region of the parking position are configured such that the plastic contact portion of the track is deformable to form a depression and the load-transmitting rolling body is substantially stable in shape, and wherein the depression is concave within the region of the parking position of the track.

18. An arrangement comprising:

a stationary furniture part, a movable furniture part movable relative to the stationary furniture part, a guide rail to be mounted to the stationary furniture part, and a guide device to be coupled to the moveable furniture part, the guide device having a load-transmitting rolling body, wherein the guide rail has a track on which the load-transmitting rolling body is moveably mounted, the track having a parking position for the load-transmitting rolling body, and the parking position corresponds to an end position of the moveable furniture part relative to the stationary furniture part, wherein the track of the guide rail has a plastic contact portion and a support structure supporting the plastic contact portion and non-integrated with the plastic contact portion, wherein the load-transmitting rolling body and the track at least in a region of the parking position are configured such that the plastic contact portion of the track is deformable to form a depression and the load-transmitting rolling body is substantially stable in shape, and wherein the depression is formed by the load-transmitting rolling body in the region of the parking position such that the depression has a shape corresponding to a shape of the load-transmitting rolling body.

19. An arrangement comprising:

a stationary furniture part, a movable furniture part movable relative to the stationary furniture part, a guide rail to be mounted to the stationary furniture part, and a guide device to be coupled to the moveable furniture part, the guide device having a load-transmitting rolling body, wherein the guide rail has a track on which the load-transmitting rolling body is moveably mounted, the track having a parking position for the load-transmitting rolling body, and the parking position corresponds to an end position of the moveable furniture part relative to the stationary furniture part, wherein the load-transmitting rolling body and the track at least in a region of the parking position are configured such that the track is deformable to form a depression and the load-transmitting rolling body is substantially stable in shape, wherein a hardness of the load-transmitting rolling body is greater than a hardness of the track at least in the region of the parking position, wherein the arrangement further comprises a securing element configured to fix the contact portion to the guide rail, the securing element configured to at least one of:

(i) be substantially U-shaped and/or have a spring element and/or a friction element for increasing the friction at a contact contour formed as a groove of the guide rail, (ii) have an actuating element by which the securing element and the contact portion connected thereto are moveable, and (iii) be releasably fixed to the contact portion by a latching device having a latching recess and a latching projection.

* * * * *